US005826136A

United States Patent [19]

Saiko et al.

[11] Patent Number: 5,826,136

[45] Date of Patent: Oct. 20, 1998

[54] IMAGE STABILIZING METHOD FOR USE IN AN IMAGE FORMING APPARATUS

[75] Inventors: Hideji Saiko; Motoyuki Itoyama, both of Yamatokoriyama; Jitsuo Masuda, Yamatotakada; Toshihisa Ishida, Kashiba; Katsuhiro Nagayama, Yamabe-gun; Hiroo Naoi, Yamatokoriyama; Masayasu Narimatsu, Nara; Tomoko Nishino, Yamatokoriyama, all of Japan

[73] Assignee: Sharp Kabushiki Kaisha, Osaka, Japan

[21] Appl. No.: 821,933

[22] Filed: Mar. 21, 1997

[30] Foreign Application Priority Data

Mar. 21, 1996 [JP] Japan ..... 8-064301

[51] Int. Cl.[6] ..... G03G 15/08

[52] U.S. Cl. ..... 399/49; 399/50; 399/58; 399/59; 399/94

[58] Field of Search ..... 399/43, 49, 44, 399/50, 53, 55, 51, 58, 59, 94, 97

[56] References Cited

U.S. PATENT DOCUMENTS 5,333,037 7/1994 Inoue et al. ..... 399/49

5,532,794 7/1996 Tokuyama et al. ..... 399/49

FOREIGN PATENT DOCUMENTS 6-11929A 1/1994 Japan .

6-19259A 1/1994 Japan .

*Primary Examiner*—Arthur T. Grimley

*Assistant Examiner*—Quana Grainger

[57] ABSTRACT

CPU is designed to create toner patches on the surface of the photoreceptor drum and pick up the detected data of the density of the toner patches by a photosensor. CPU calculates a correcting value ΔVg of the charger output in accordance with the picked up detected data, and compared the corrected charger output Vg with (Vgs+α) and (Vgs−α). If the corrections in the same direction are repeated in a row, kβ (where 0<k<1) is added to or subtracted from the toner density reference value. When the direction of the correction for the toner concentration reference value to be made is opposite that of the previous one, the absolute value of the correcting value for the current correction is set to be the absolute value of the previous one.

7 Claims, 11 Drawing Sheets

IMAGE STABILIZING METHOD FOR USE IN AN IMAGE FORMING APPARATUS

BACKGROUND OF THE INVENTION (1) Field of the Invention

The present invention relates to an image stabilizing method for use in image forming apparatuses such as copiers, laser printers and the like which perform image forming based on the electrophotographic process and in particular, is directed to an image stabilizing method for controlling toner density for the purpose of stabilization of the image.

(2) Description of the Prior Art

In an image forming apparatus using the electrophotographic process such as a copier, the surface of the photoreceptor forming a static latent image after the charging stage and the exposure stage is supplied with developer from the developing unit so that the static latent image can be visualized into a developed image. This developed image is transferred to a sheet of paper. Thus, the image forming process is performed. The image formed in this image forming process is affected by the conditions of the process parameters concerning the photoreceptor, charger, exposure device, transfer device, the developer in the developing unit and the like. The conditions of these parameters vary depending upon environmental variations such as temperature, humidity and the like as well as depending upon variations due to passage of time. Hence, in order to keep the image formed on the sheet in a good condition, the conditions of the parameters which affect the state of the image formed, need to be controlled appropriately in accordance with the environmental variations such as temperature, humidity and the like and in accordance with variations with passage of time.

In the invention disclosed in Japanese Patent Application Laid-Open Hei 6 No. 51,551, toner patches are formed with the developer in a predetermined region on the photoreceptor so that the density of the toner patches is compared to the density of the non-image area, to thereby modify the aforementioned parameters. In the invention disclosed in Japanese Patent Application Laid-Open Hei 6 No. 19,259, the operating voltage of the exposure lamp is changed periodically after a predetermined number of copies. Each time the operating voltage of the exposure lamp is changed, the relationship between the output signal from the original density detecting sensor and the developer bias voltage is adapted and corrected in accordance with the change in the operating voltage. Further, in the invention disclosed in Japanese Patent Application Laid-Open Hei 6 No. 11,929, when process control based on a toner patch scheme is performed, the amount of the leftover toner adhering in the toner patch area is detected after an actual sheet passing operation. Based on this detected value, the output power for charge erasure before clearing is controlled.

However, in conventional image stabilizing methods, a deep consideration was not given concerning conditions for image forming depending upon environmental variations as well as variations due to passage of time. Therefore, it was difficult to keep the quality of the initial image constant to the end of the life cycle. For example, in order to maintain a high quality of image, it is necessary to keep the toner concentration in the developer in a proper condition. After exposure to a high temperature, high humidity environment, alternatively after a prolonged period in the unused state, or the like, the amount of static charge on the toner in the developer is low, causing various problems such as low gradation due to a rise in image density, the increase in toner consumption, the outbreak of fogginess, scattering of toner, etc. To avoid these problems, the concentration of toner in the developing unit needs to be reduced. On the other hand, after operation under a low temperature, low humidity environment or after a continuous copying operation, or the like, the amount of static charge on the toner in the developer is high, causing problems such as lowering of the image density, degradation of transferring performance, etc. Therefore, it is necessary to increase the toner concentration in the developing unit.

SUMMARY OF THE INVENTION

It is therefore an object of the present invention to provide an image stabilizing method for use in an image forming apparatus, whereby in order to eliminate the problems such as the rise of the image density, the lowering of the contrast and the image density, due to variation in the amount of static charge on the toner in the developer, the toner concentration in the developing unit is appropriately controlled in accordance with the conditions of parameters which affect the state of the image formed, to thereby maintain the quality of the initial image to the end of the life.

The present invention has been devised to attain the above object, and the gist of the invention is as follows:

In accordance with a first aspect of the invention, an image stabilizing method for use in an image forming apparatus, comprises the steps of:

creating toner patches on the surface of the photoreceptor;

detecting the density of the toner patches;

correcting the charger output in accordance with the density of toner patches detected; and implementing process control for correcting the toner concentration in the developing unit if the correcting amount of the charger output excesses a predetermined value, wherein if the toner concentration is corrected at the current process control, a concentration stabilizing treatment for stabilizing the image density is implemented before the start of the next process control.

A second aspect of the invention resides in an image stabilizing method for use in an image forming apparatus defined in the above first feature, wherein the concentration stabilizing treatment comprises wait of a certain period of time before the next process control starts.

A third aspect of the invention resides in an image stabilizing method for use in an image forming apparatus defined in the above first feature, wherein the concentration stabilizing treatment is implemented during a copying process after the current process control.

A fourth aspect of the invention resides in an image stabilizing method for use in an image forming apparatus defined in the above first feature, wherein the concentration stabilizing treatment comprises modification of parameters affecting the state of the image formed, except the charger output and the toner concentration.

In accordance with a fifth aspect of the invention, an image stabilizing method for use in an image forming apparatus, comprises the steps of:

creating toner patches on the surface of the photoreceptor;

detecting the density of the toner patches;

correcting the charger output in accordance with the density of toner patches detected; and implementing process control for correcting the toner concentration in the developing unit if the correcting amount of the charger output excesses a predetermined value, wherein modification of the correcting amount for modifying the correcting amount of the toner concentration is implemented in accordance with the conditions of parameters affecting the state of the image formed, except the toner concentration.

A sixth aspect of the invention resides in image stabilizing method for use in an image forming apparatus defined in the above fifth feature, wherein the correcting amount modification comprises modification of the correcting amount of the toner concentration in accordance with the corrected state of the charger output.

A seventh aspect of the invention resides in image stabilizing method for use in an image forming apparatus defined in the above fifth feature, wherein the correcting amount modification comprises modification of the correcting amount of the toner concentration in accordance with the conditions of the surrounding environment.

In accordance with the first aspect of the invention, since a process for stabilizing the toner concentration is implemented during the period before the next process control starts, it is possible to prevent excessive control from being implemented before stabilization of the toner concentration, whereby the proper state of the image formed can be maintained.

In accordance with the second aspect of the invention, since the next process control is suspended to start until a certain period of time has elapsed, it is possible to implement the next process control in a condition where the toner concentration in the developing unit has been stabilized.

In accordance with the third aspect of the invention, since the concentration stabilizing treatment is implemented during a copying process after the current process control, it is possible to implement the next process control in a condition where the toner concentration in the developing unit has been stabilized.

In accordance with the fourth aspect of the invention, since parameters affecting the state of the image formed, except the charger output and the toner concentration, are modified, occurrence of fogginess etc., due to the variation in the toner concentration can be prevented so that it is possible to maintain a proper state of the image formed.

In accordance with the fifth aspect of the invention, since the correcting amount for the toner concentration is modified in accordance with the conditions of parameters affecting the state of the image formed, except the toner concentration, the toner concentration can be modified finely and minutely, by reflecting the conditions of the parameters except the toner concentration.

In accordance with the sixth aspect of the invention, since the correcting amount for the toner concentration is modified in accordance with the corrected condition of the charger output, the toner concentration can be corrected finely and minutely in accordance with the corrected state of the charger output, thus making it possible to maintain the state of the image formed properly.

In accordance with the seventh aspect of the invention, since the correcting amount for the toner concentration is modified in accordance with conditions of a surrounding environment, the toner concentration can be corrected finely and minutely in accordance with the conditions of the surrounding environment, thus making it possible to maintain the state of the image formed properly.

DESCRIPTION OF THE PREFERRED EMBODIMENTS

Figure 1:
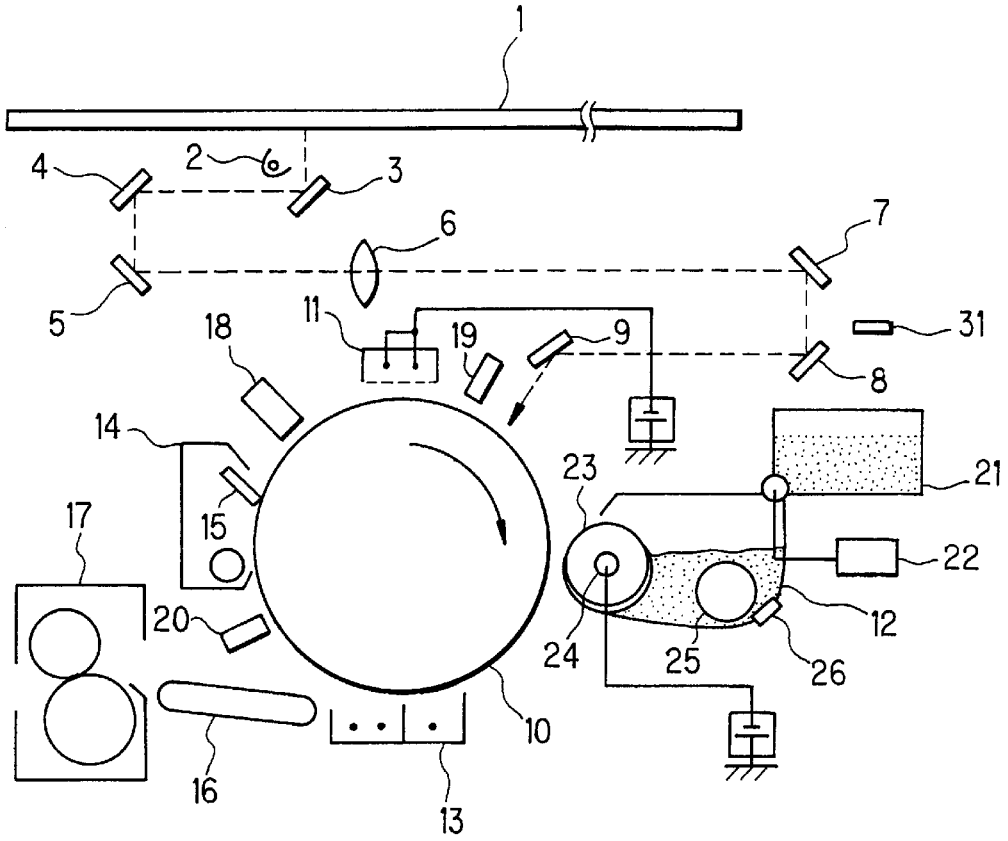
FIG. 1 is a view showing the configuration of essential components of a copier of the invention.

FIG. 1 is a schematic front sectional view showing the configuration of a typical copier in accordance with the image forming apparatus in accordance with an embodiment of the invention. Arranged below an original table 1 is an optical system which is composed of exposure lamp 2, mirrors 3 to 5 and 7 to 9 and a lens 6. Under this optical system, a photoreceptor drum 10, a charger 11, a developing unit 12, a transfer unit 13, a cleaning device 14 having a cleaning blade 15, a conveyor belt 16, a fixing unit 17, a charge erasing lamp 18, a blank lamp 19 and a photosensor 20 are provided. Developing unit 12 includes a toner hopper 21, a toner supplying motor 22, a non-magnetic sleeve 23, a magnet 24, an agitating roller 25 and a toner concentration sensor 26.

Figure 2:
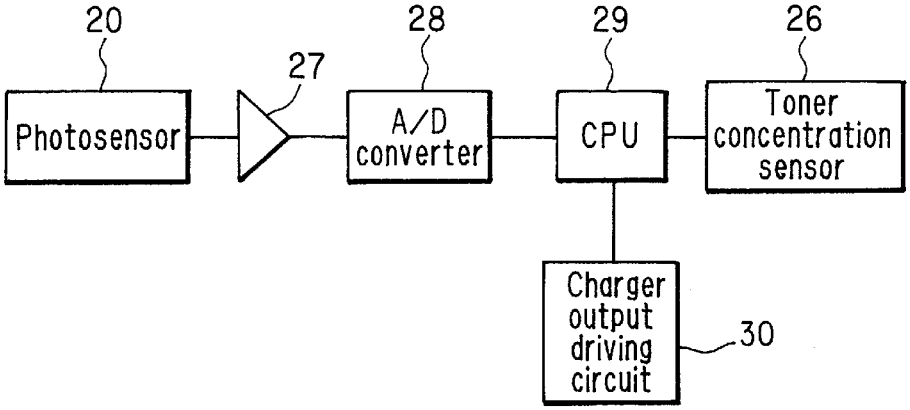
FIG. 2 is a block diagram showing the configuration of essential components of the controlling portion of the same copier.

FIG. 2 is a block diagram showing essential components of the controlling portion in the aforementioned copier. Connected to a CPU 29 which constitutes a controller of the copier are a toner concentration sensor 26, an A/D converter 28 and a charger output driving circuit 30, together with unillustrated input/output devices. Toner concentration sensor 26 detects the toner concentration in the developer in developing unit 12 and inputs the detected signal to CPU 29. A photosensor 20 is connected to A/D converter 28 through an amplifier 27. Photosensor 20 detects the density of toner patches created in the aftermentioned process control. The detected signal is amplified by amplifier 27, and then this is converted into digital data by means of A/D converter 28 so as to be inputted to CPU 29. CPU 29 controls the operation of toner supplying motor 22 based on the detection signal from toner concentration sensor 26 during the copying process. CPU 29 further controls the operation of the charger output driving circuit 30 on the basis of the digital data inputted from A/D converter 28 in the aftermentioned process control.

The operation of the copying process of the copier thus configured will be described. First, as the copy start switch (not shown) is operated after the original was placed on original table 1, exposure lamp 2 together with mirrors 3 to 5 moves horizontally along the underside of original table 1 to scan the image on the original with exposure lamp 2. Light from exposure lamp 2 reflects on the image surface of the original and the reflected light goes through mirrors 3 and 5, lens 6 and mirrors 7 to 9 to reach the surface of photoreceptor drum 10. The surface of photoreceptor drum 10 has been electrified with charges of like polarity by the corona discharge from charger 11 prior to the irradiation of the reflected light from the original. The irradiation of the reflected light creates a static latent image on the surface of photoreceptor drum 10. Here, electrical charge in unwanted areas on the surface of photoreceptor drum 10 is eliminated by selective irradiation of light from blank lamp 19.

The surface of photoreceptor drum 10 with the static latent image formed thereon is supplied with the developer from developing unit 12 so that the static latent image is visualized into a developed image. This developed image is transferred to a sheet of paper by transfer device 13. The sheet with an image of developer transferred thereon is conveyed by conveyor belt 16 to fixing unit 17 where the image of developer is fused and fixed with heat under pressure. From the surface of photoreceptor drum 10 after transfer of the developed image, leftover toner is removed by cleaning unit 14 and remaining static charge is eliminated by charge erasing lamp 18. Thereafter, the photoreceptor surface is charged again by charger 11.

In developing unit 12, non-magnetic sleeve 23 is made to rotate opposite photoreceptor drum 10. Agitating roller 25 agitates toner and carriers constituting the developer in developing unit 12 in order to electrify toner with static charge. The developer is conveyed by the function of magnet 24 affixed inside non-magnetic sleeve 23, whereby only the toner of the developer moves to the surface of photoreceptor drum 10. Accordingly, implementation of the copying process consumes only toner from the developing unit 12. For this reason, toner concentration sensor 26 detects the toner concentration in the developer in developing unit 12. Based on the comparison of the detected concentration with a previously stored toner concentration reference value, toner supplying motor 22 is made to rotate so that toner held in toner hopper 21 is supplied into developing unit 12. That is, CPU 29 controls the system such that the toner concentration in the developing unit 12 detected by toner concentration sensor 26 will correspond to the toner concentration reference value.

CPU 29 interrupts the copying process and implements process control at times when the copier is activated and at regular intervals under predetermined conditions. In this process control, toner patches are formed on the surface of photoreceptor drum 10 so that the density of the toner patches is detected by photosensor 20. As stated above, the output signal from photosensor 20 is amplified by amplifier 27 and then it is converted by A/D converter 28 into digital data to be inputted to CPU 29. CPU 29, based on the output data from photosensor 20, controls the operation of charger output driving circuit 30, etc., to thereby modify the conditions of the parameters which affect images to be formed.

Specifically, a static latent image having different surface potentials is formed on photoreceptor drum 10 by changing the output power of charger 11. Then, this latent image is visualized by developing unit 12, thus forming a plurality of toner patches having different densities. These densities are detected using photosensor 20 to be compared to the reference value so that the charger output in association with the toner patch matching the reference value will be adopted as the charger power for the copying process from here on.

Here, the number of the toner patches forming different densities is limited. Therefore, the reference value does not always match one of the toner densities of the toner patches. If no toner patch has a density matching the reference value, the two detected values P1 and P2 from photosensor 20 (here, $P1<P<P2$) closest to P are selected and a desired charger output Vg is determined as follows: That is, from known Vg1, P1, Vg2 and P2, 'a' and 'b' in the following equations are calculated:

$$Vg1=aP1+b$$

$$Vg2=aP2+b.$$

Using the obtained 'a' and 'b', the charger output Vg is calculated from $Vg=aP+b$.

Figure 3:
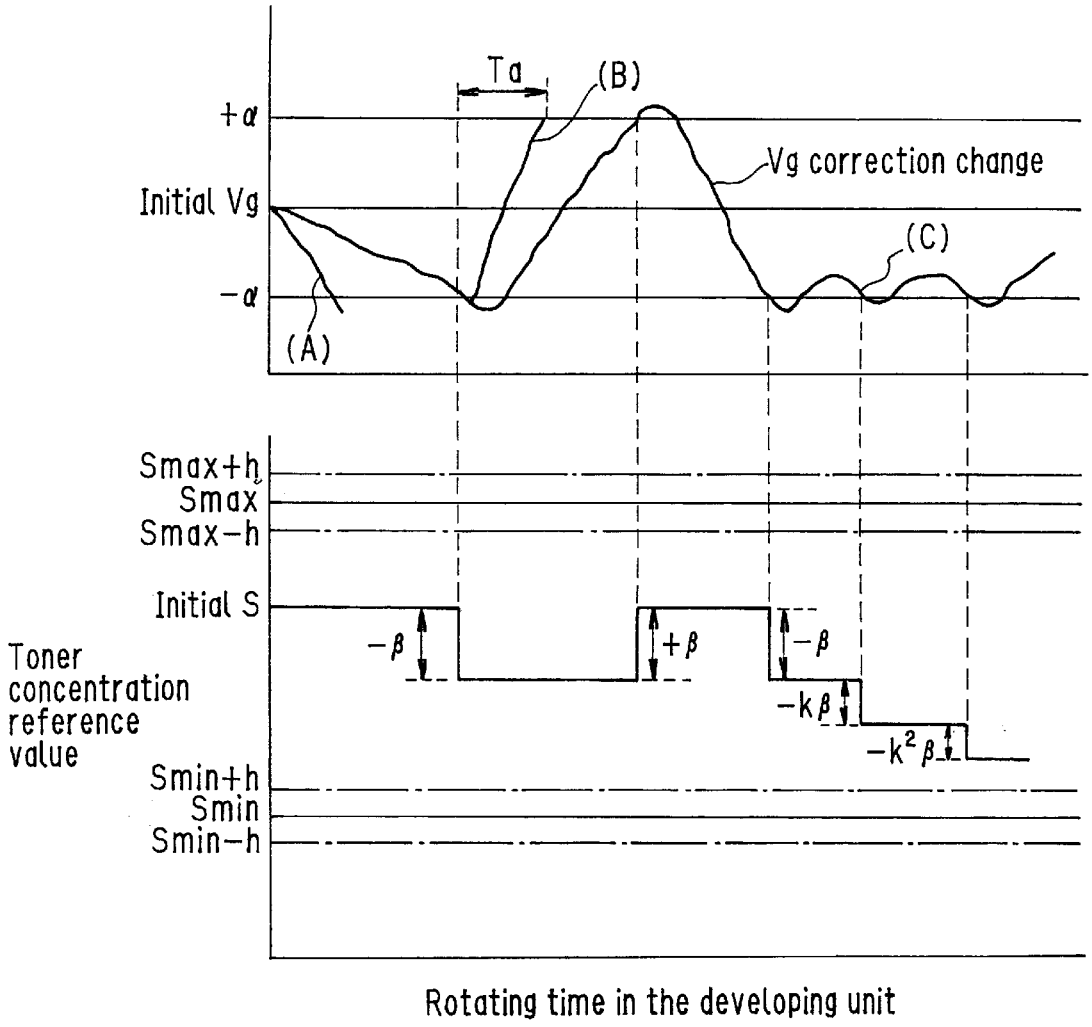
FIG. 3 is a chart showing variation in the charger output and change in toner concentration reference value with respect to the agitating time in the same copier.

In the above way, the charger output Vg is periodically modified and changes as shown in FIG. 3.

Illustratively, when the process control was implemented, and if the charger output Vg after the correction is $(Vgs-\alpha)$ or below (Vgs is the initial value), the development is judged to be excessive, then the toner concentration reference value is reduced by a correcting value $\beta$. This reduces the toner concentration in developing unit 12. This modified toner concentration reference value will be maintained until the charger output Vg after the correction changes to $(Vgs+\alpha)$ in a future process control. In contrast, when the charger output Vg after the correction is $(Vgs+\alpha)$ or above, the development is judged to be too low, the toner concentration reference value is increase by the correcting value $\beta$. This increases the toner concentration in developing unit 12. This modified toner concentration reference value will be maintained until the charger output Vg after the correction changes to $Vgs-\alpha$ in a future process control.

The above process control enables maintenance of stabilized quality of image over a prolonged period of time. The agitating time in the developer tank, taken as the abscissa indicates the rotating time of non-magnetic sleeve 23, which is a cumulative operating time of developer unit 12 after the activation of power.

Figure 4:
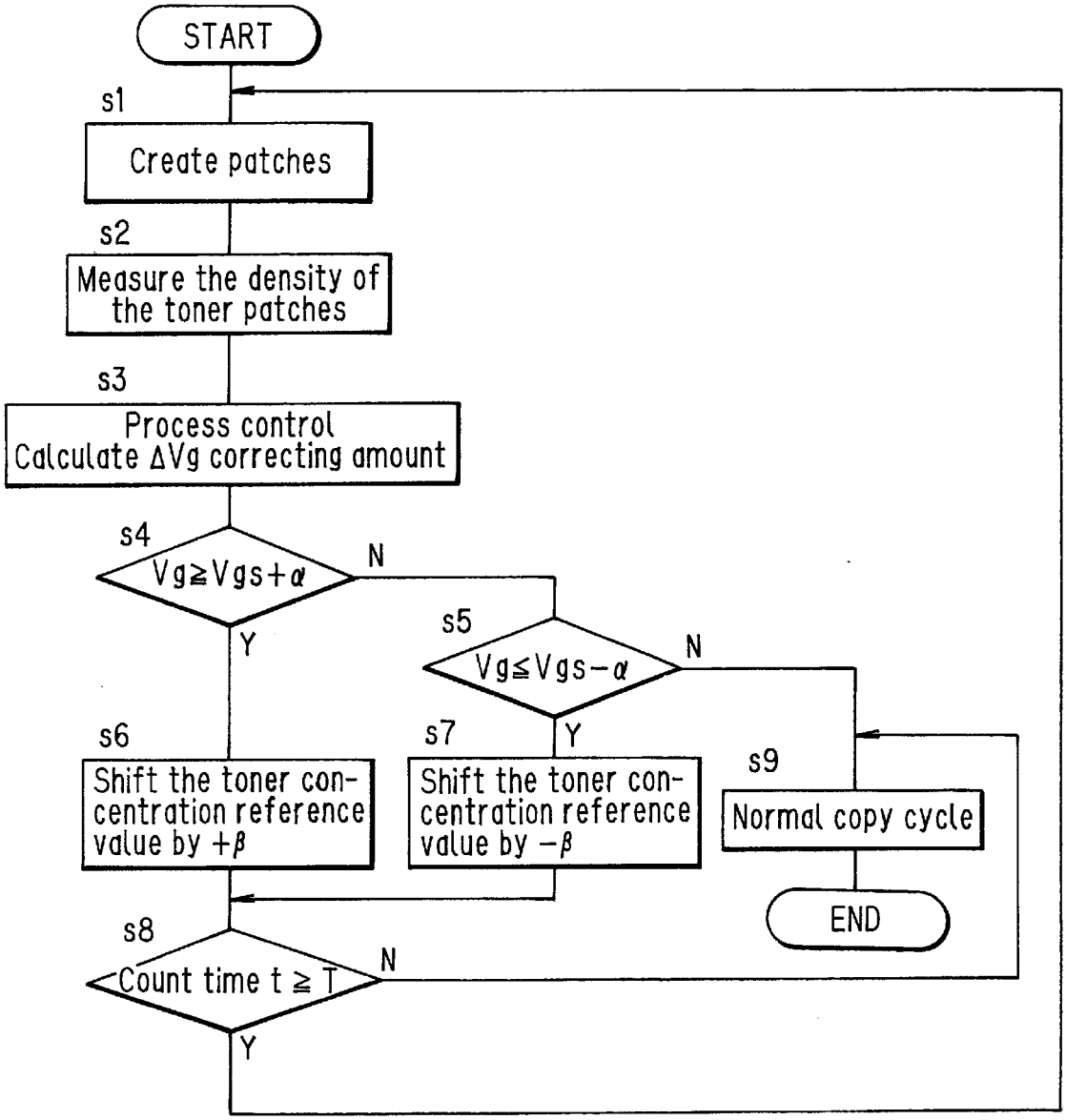
FIG. 4 is a flowchart showing the procedure of the process control in the controlling portion of the copier of an embodiment in accordance with the second feature of the invention.

FIG. 4 is a flowchart showing the procedure of the process control in the controlling portion of the copier of an embodiment in accordance with the second feature of the invention. First, CPU 29 creates toner patches on the surface of photoreceptor drum 10 (s1). Then, CPU 29 picks up the data on the density of toner patches detected by photosensor 20 (s2). CPU 29 calculates a correction value $\Delta Vg$ for the charger output based on the picked up detected data (s3). Then, the corrected charger output Vg is compared with $(Vgs+\alpha)$ and $(Vgs-\alpha)$(s4 and s5).

When the corrected charger output Vg is $(Vgs+\alpha)$ or above, $\beta$ is added to the toner concentration reference value (s6). When the corrected charger output Vg is $(Vgs-\alpha)$ or below, $\beta$ is subtracted from the toner concentration reference value (s7). Once the toner concentration reference value is modified, CPU 29 will perform normal copying processes without implementing the next process control, until a predetermined period of time T elapses. After the predetermined period T has elapsed, the next process control is implemented (s8). While corrected charger output Vg is within the range of Vgs ±α, normal copying processes are carried out without modifying the toner concentration reference value (s9).

For example, suppose that α=+100 V, β=10 counts (which is a modifying amount corresponding to the increase in the toner concentration by 0.5%), and the next process control is set to start after the passage of the predetermined period T =200 s. By this setup, it is possible to start the next process control after the appearance of the effects due to the currently modified toner concentration reference value, so as to prevent excessive control from being implemented before the toner concentration in developing unit 12 has been stabilized.

Figure 5:
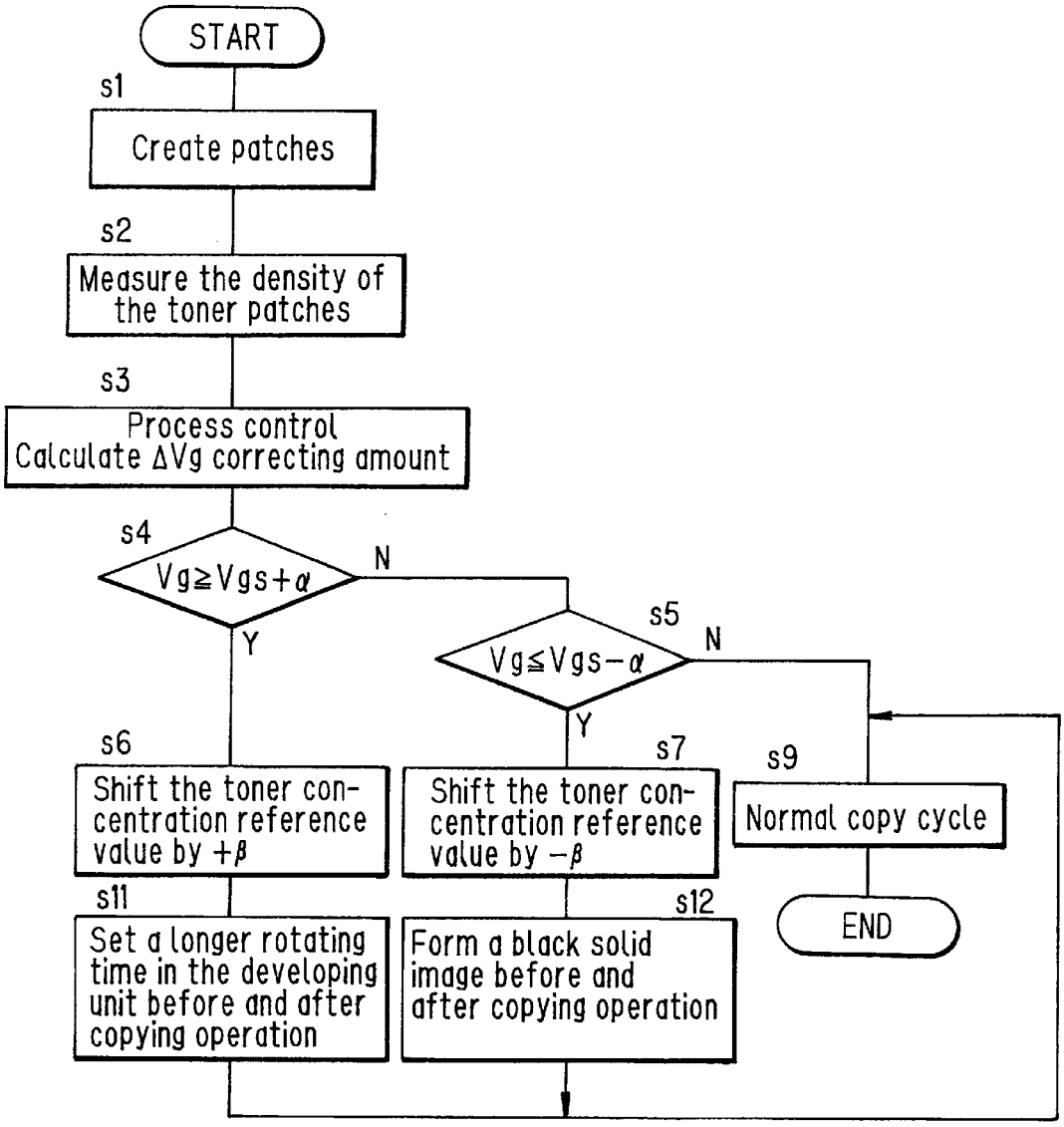
FIG. 5 is a flowchart showing the procedure of the process control in the controlling portion of the copier of an embodiment in accordance with the third feature of the invention.

FIG. 5 is a flowchart showing the procedure of the process control in the controlling portion of the copier of an embodiment in accordance with the third feature of the invention. When the corrected charger output Vg is (Vgs+α) or above and therefore β is added to the toner concentration reference value, static charge on the toner in developing unit 12 lowers because toner is supplied all at once to developing unit 12. Taking into account this fact, CPU 29 sets a longer rotating time for agitating roller 25 before and after the copying process than usual (s6→s11). In contrast, when the corrected charger output Vg is (Vgs−α) or below and therefore β is subtracted from the toner concentration reference value, it takes a long time to stabilize the toner concentration in developing unit 12. Taking into account this fact, CPU 29 instruct the forming of a black solid image before and after the copying process (s7→s12). By this setup, it is possible to forcefully stabilize the toner concentration in developing unit 12 to match the reduced toner concentration reference value.

Figure 6:
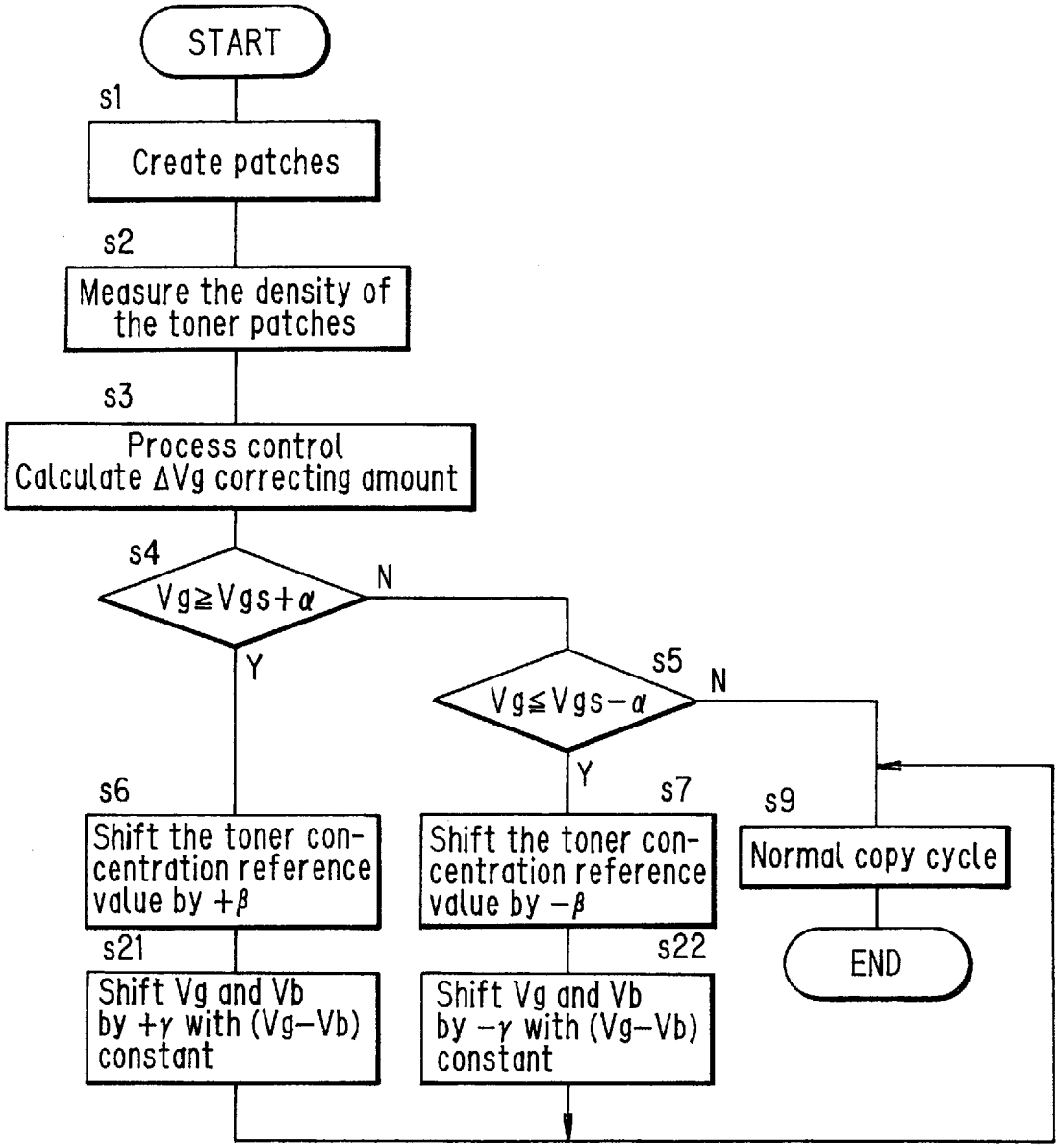
FIG. 6 is a flowchart showing the procedure of the process control in the controlling portion of the copier of an embodiment in accordance with the fourth feature of the invention.

FIG. 6 is a flowchart showing the procedure of the process control in the controlling portion of the copier of an embodiment in accordance with the fourth feature of the invention. When the corrected charger output Vg is (Vgs+α) or above and therefore β is added to the toner concentration reference value, the amount of static charge on the toner in developing unit 12 is reduced causing fogginess in the image. Taking into account this fact, CPU 29 subtracts a correcting value γ from charger output Vg and from developing bias Vd (s6→s21). In contrast, when the corrected charger output Vg is (Vgs−α) or below and therefore β is subtracted from the toner concentration reference value, the correcting value γ is added to charger output Vg as well as to developing bias Vd (s7→s22). In this way, with the difference between the charger output Vg and the developing bias Vd unchanged, the developing bias Vd is corrected to maintain the effect due to the correction of the charger output, thus it is possible to prevent fogginess in the image. As an example, when β=10 then γ=30 V.

Figure 7:
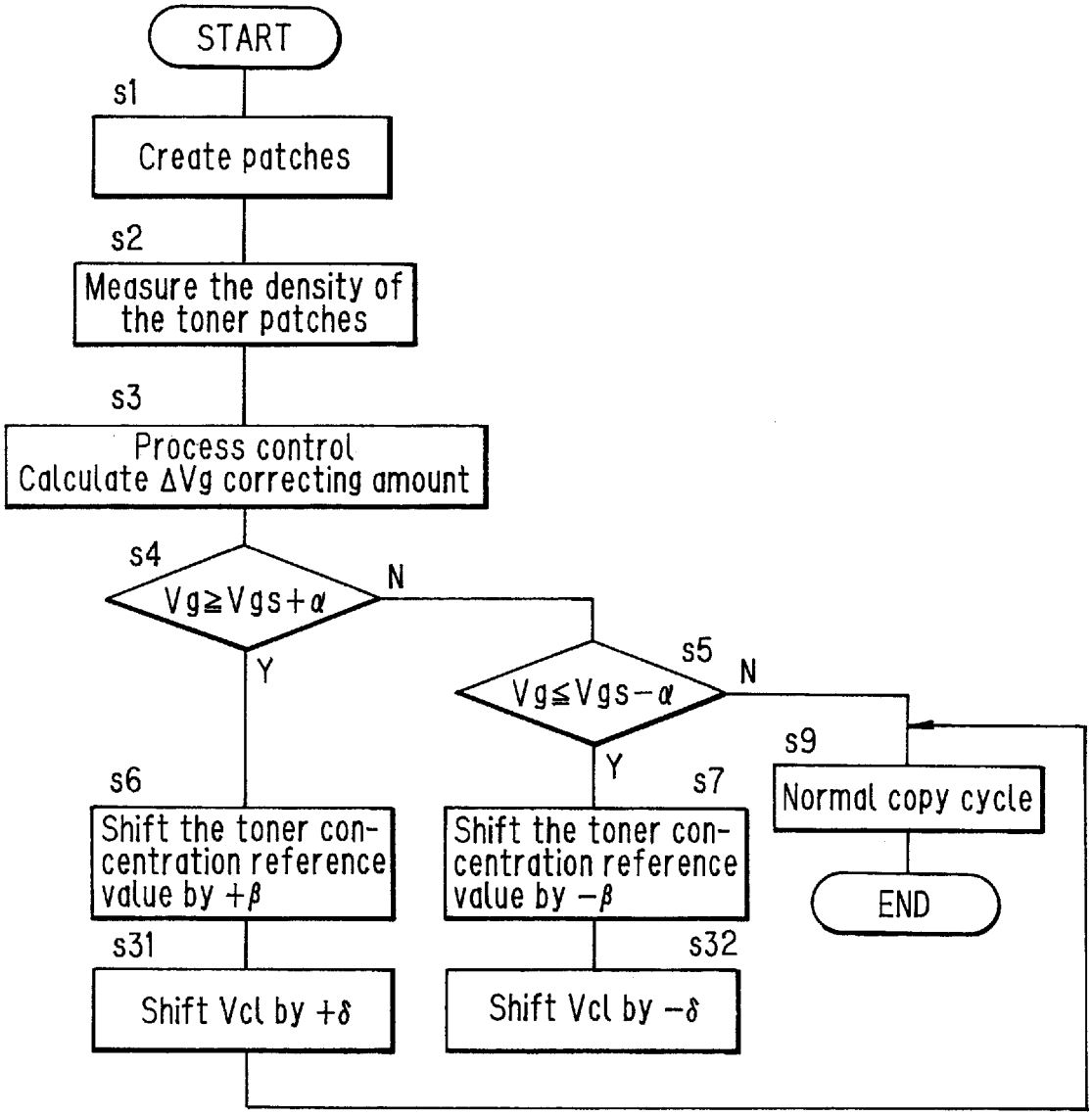
FIG. 7 is a flowchart showing the procedure of the process control in the controlling portion of the copier of another embodiment in accordance with the fourth feature of the invention.

FIG. 7 is a flowchart showing the procedure of the process control in the controlling portion of the copier of another embodiment in accordance with the fourth feature of the invention. CPU 29 adds a correcting value δ to the exposure lamp voltage Vc1 to prevent fogginess in the image due to the reduction in the amount of static charge on the toner in developing unit 12 when β is added to the toner concentration reference value (s6→s31). In contrast, when β is subtracted from the toner concentration reference value, the correcting value δ is subtracted from the exposure lamp voltage Vc1 (s7→s32). As an example, when β=10 then γ=0.63 V.

Figure 8:
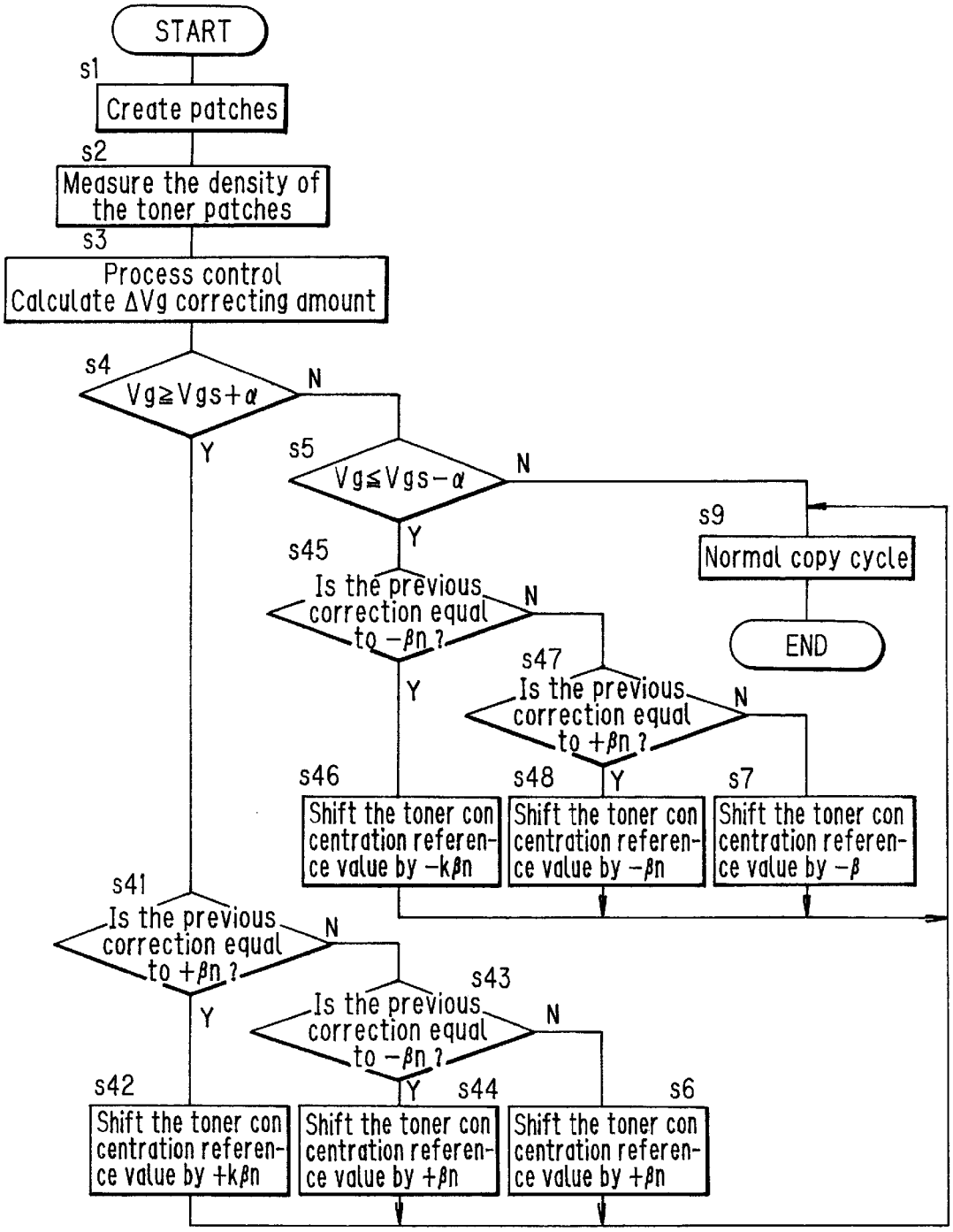
FIG. 8 is a flowchart showing the procedure of the process control in the controlling portion of the copier of an embodiment in accordance with the sixth feature of the invention.

FIG. 8 is a flowchart showing the procedure of the process control in the controlling portion of the copier of an embodiment in accordance with the sixth feature of the invention. When the corrected charger output Vg is (Vgs−α) or below and the corrections of subtracting β from the toner concentration reference value are repeated continuously, the toner concentration may be excessively modified. In such a case, the charger output Vg will be modified greater than (Vgs+α). To deal with this, when the corrections in the same direction are continuously carried out, CPU 29 adds kβ (0<k<1) to, or subtracts kβ from, the toner concentration reference value (s4→s41→s42→s5→s45→s46) so that the result after the corrections from the second one on will fall within a proper range. Specifically, when n times of corrections of the toner concentration reference value in the same direction in a row are carried out, as shown in FIG. 3(C), the correcting value $\beta_n$ for the nth toner concentration reference value is set to $\beta_n=k\beta_{n-1}$. When the direction of the correction for the toner concentration reference value to be made is opposite that of the previous one, the absolute value of the correcting value for the current correction is set to be the absolute value of the previous one (s43→s44, s47→s48). When for β=10, for example, the correction Vg=Vgs+100 V, is made, the next correction is made with k=0.6 or kβ=6 .

Figure 9:
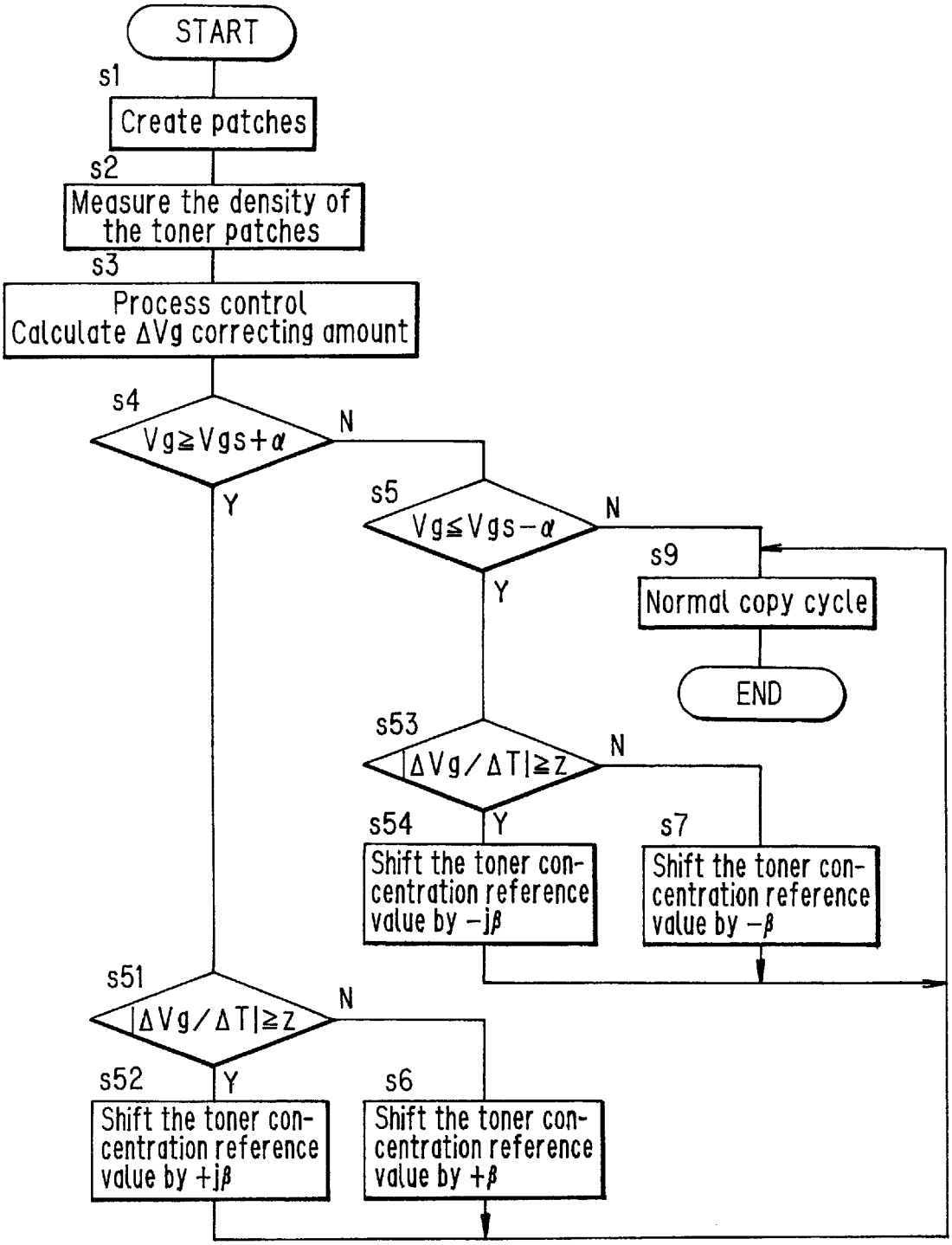
FIG. 9 is a flowchart showing the procedure of the process control in the controlling portion of the copier of another embodiment in accordance with the sixth feature of the invention.

FIG. 9 is a flowchart showing the procedure of the process control in the controlling portion of the copier of another embodiment in accordance with the sixth feature of the invention. When the toner concentration in developing unit 12 is grossly incorrect, the correcting amount of the charger output turns out to be large as shown in FIG. 3(A). To deal with this, or in order to stabilize the toner concentration in developing unit 12 to the correct value as soon as possible, CPU 29 compares the variation ΔVg in the charger output per unit time ΔT for the toner concentration reference value before the correction to a predetermined value z, and sets the correcting amount of the toner concentration reference value at jβ (where 1<j) if $|\Delta Vg/\Delta T| \geqq z$ (s51→s52, s53→s54). For example, suppose z=0.8 V/s. When the correction Vg=Vgs−100 V was made, the toner concentration reference value is usually corrected with+β=+7, but the correction is made with+10 counts, assuming j=1.4.

Figure 10:
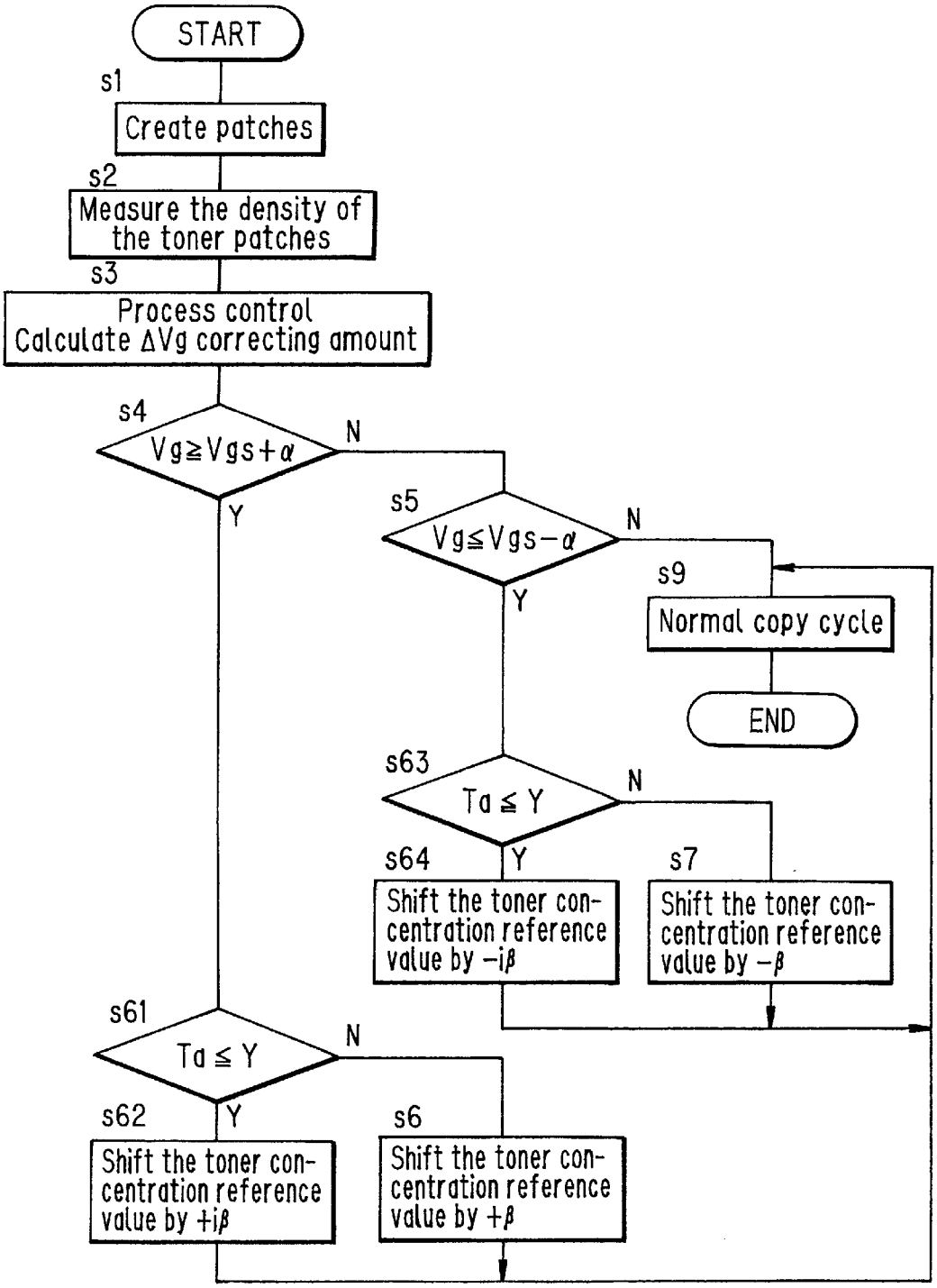
FIG. 10 is a flowchart showing the procedure of the process control in the controlling portion of the copier of still another embodiment in accordance with the sixth feature of the invention.

FIG. 10 is a flowchart showing the procedure of the process control in the controlling portion of the copier of still another embodiment in accordance with the sixth feature of the invention. Suppose that the charger output has changed from (Vgs−α) to (Vgs+α) in a short span of time after the correction of the toner concentration reference value, shown in FIG. 3(B), the correcting amount for the toner concentration reference value is considered to be too great. To deal with such a case, when time Ta required for the charger output to change from (Vgs−α) to (Vgs+α) is a predetermined value Y or below, the toner concentration reference value is corrected with iβ (where 0<i<1) (s61→s62, s63→s64). For example, when time Ta taken for the charger output to change from (Vgs−100 V) to (Vgs+100 V) after the correction of the toner concentration reference value with −β=−15, is 1100 sec or below, the toner concentration reference value is set up to be corrected with +β=+9 using i=0.6. This setup prevents a sharp change in the charger output.

Figure 11A:
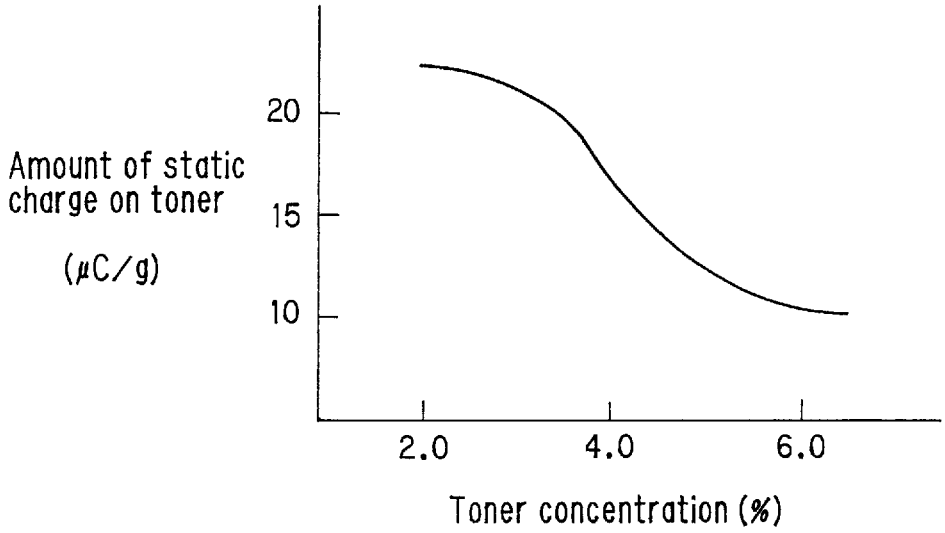
FIG. 11A is a chart showing the relation between the toner concentration and the amount of charge on the toner in the copier of FIG. 10.
Figure 11B:
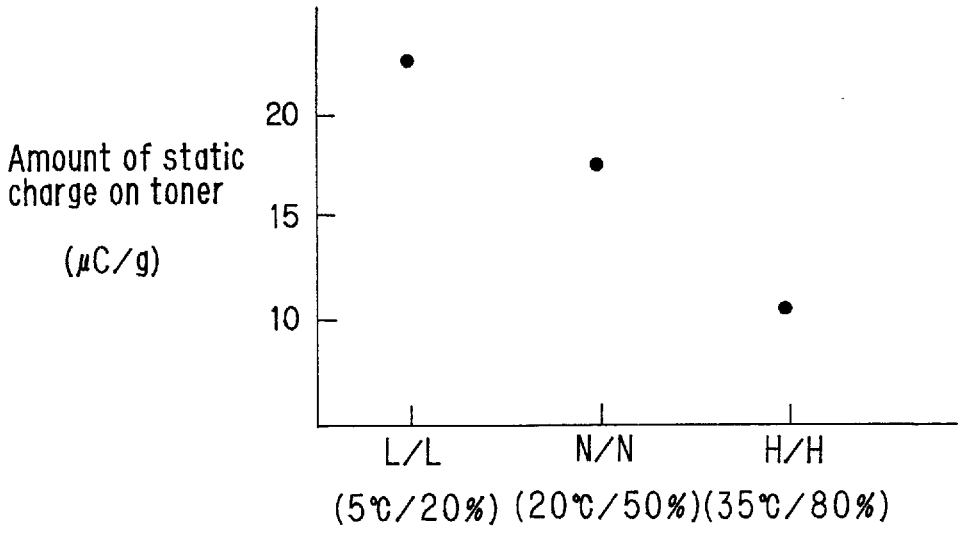
FIG. 11B is a chart showing the relation between the conditions of the surrounding environments and the amount of charge on the toner in the copier of FIG. 10.

As shown in FIG. 11A, if the toner concentration is too high, the amount of static charge on the toner lowers causing fogginess whereas a too low toner concentration may cause carrier defects. For this reason, it is easy to hit upon on the idea that the toner concentration reference value is set between a minimum value Smin and a maximum value Smax. Further, as shown in FIG. 11B, even if the toner concentration reference value is constant, the amount of static charge on the toner is high at a low temperature, low humidity environment, and it becomes lower as the environment changes to higher temperature and higher humidity. Therefore, a temperature/humidity sensor 31 is provided to measure the outside surroundings. If the environment is in a low temperature and low humidity state, the range of the toner concentration reference value S is set to be $Smin-h \leqq S \leqq Smax-h$ (where $0<h$). If the environment is in a high temperature and high humidity state, the range of the toner concentration reference value S is set to be $Smin+h \leqq S \leqq Smax+h$. For example, the range of the toner concentration reference value S at a temperature of 20° C. and a humidity of 50% is set $50 \leqq S \leqq 120$; the range at a temperature of 35° C. and a humidity of 80% is set $40 \leqq S \leqq 100$; and the range at a temperature of 5° C. and a humidity of 20% is set $60 \leqq S \leqq 130$.

Figure 12:
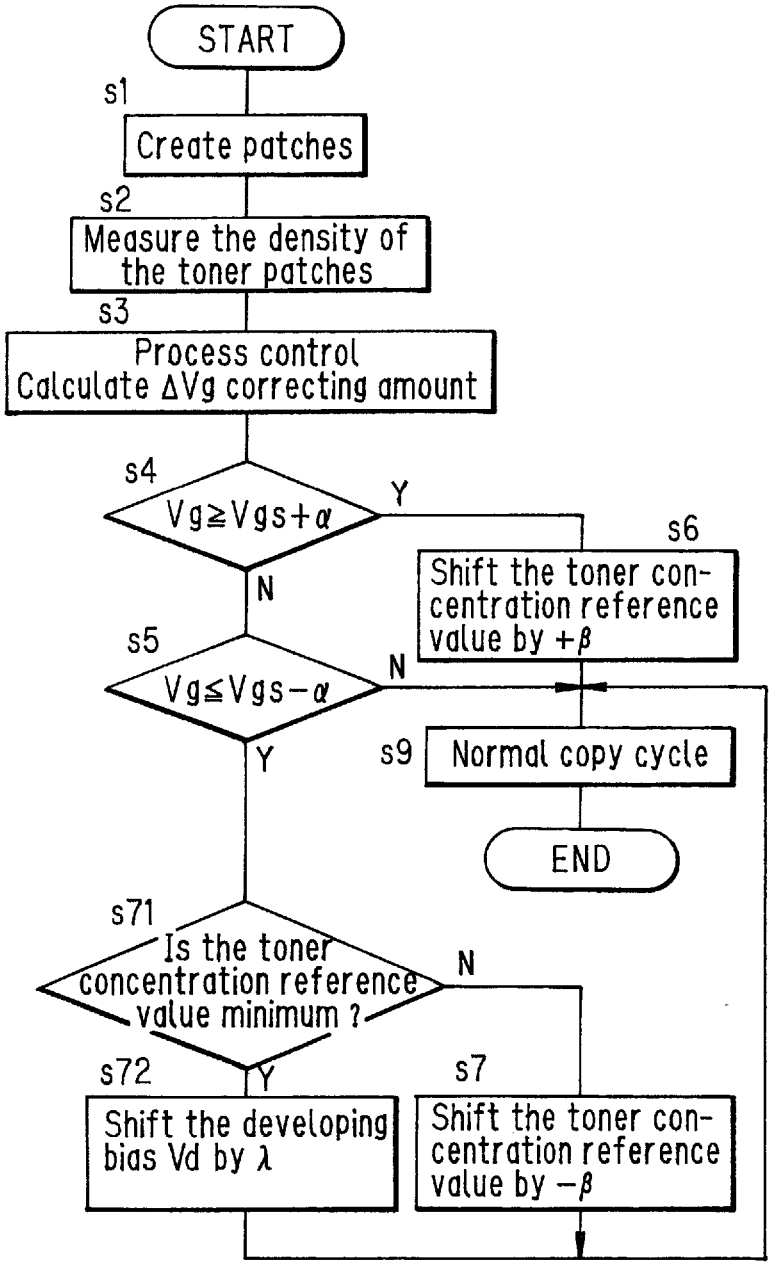
FIG. 12 is a flowchart showing the procedure of the process control in the controlling portion of the copier of still another embodiment in accordance with the fourth feature of the invention.

FIG. 12 is a flowchart showing the procedure of the process control in the controlling portion of the copier of a further embodiment in accordance with the fourth feature of the invention. When, after the toner concentration reference value S reaching the minimum value Smin after a correction, the charger output becomes ($Vgs-\alpha$) or below for the next process control, it is impossible to further lower the toner concentration reference value S in consideration of prevention of carrier defects etc. To deal with such a situation, in order to maintain the image density, $\lambda$ is added to the developing bias Vd (s71→s72). For example, when the charger output is (Vgs−100 V) or below in the case of the minimum value Smin=50 of the toner concentration reference value, the developing bias Vd is increased by 30 V. This setup prevents troubles due to a rise in the toner concentration due to carrier defects etc., and can maintain the image density properly.

It should be noted that the present invention can be applied similarly as above to image forming apparatuses other than copiers.

What is claimed is:

1. An image stabilizing method for use in an image forming apparatus, comprising the steps of:

creating toner patches on the surface of the photoreceptor;

detecting the density of the toner patches;

correcting the charger output in accordance with the density of toner patches detected; and implementing process control for correcting the toner concentration in the developing unit if the correcting amount of the charger output excesses a predetermined value, wherein if the toner concentration is corrected at the current process control, a concentration stabilizing treatment for stabilizing the image density is implemented before the start of the next process control.

2. An image stabilizing method for use in an image forming apparatus according to claim 1, wherein the concentration stabilizing treatment comprises wait of a certain period of time before the next process control starts.

3. An image stabilizing method for use in an image forming apparatus according to claim 1, wherein the concentration stabilizing treatment is implemented during a copying process after the current process control.

4. An image stabilizing method for use in an image forming apparatus according to claim 1, wherein the concentration stabilizing treatment comprises modification of parameters affecting the state of the image formed, except the charger output and the toner concentration.

5. An image stabilizing method for use in an image forming apparatus, comprising the steps of:

creating toner patches on the surface of the photoreceptor;

detecting the density of the toner patches;

correcting the charger output in accordance with the density of toner patches detected; and implementing process control for correcting the toner concentration in the developing unit if the correcting amount of the charger output excesses a predetermined value, wherein a modifying process of the correcting amount, or modification of the correcting amount of the toner concentration is implemented in accordance with the conditions of parameters which affect the state of the image formed, except the toner concentration.

6. An image stabilizing method for use in an image forming apparatus according to claim 5, wherein the modifying process of the correcting amount comprises modification of the correcting amount of the toner concentration in accordance with the corrected state of the charger output.

7. An image stabilizing method for use in an image forming apparatus according to claim 5, wherein the modifying process of the correcting amount comprises modification of the correcting amount of the toner concentration in accordance with conditions of a surrounding environment.

* * * * *